US007237688B2

(12) United States Patent
Pangerc et al.

(10) Patent No.: US 7,237,688 B2
(45) Date of Patent: Jul. 3, 2007

(54) STORAGE CONTAINER

(75) Inventors: James E. Pangerc, Parkville, MD (US); Gregory Scott Snider, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/338,483

(22) Filed: Jan. 24, 2006

(65) Prior Publication Data

US 2006/0118555 A1 Jun. 8, 2006

Related U.S. Application Data

(62) Division of application No. 09/840,278, filed on Apr. 23, 2001, now Pat. No. 7,048,133.

(51) Int. Cl.
*B65D 25/04* (2006.01)

(52) U.S. Cl. ..... 220/532

(58) Field of Classification Search ..... None
See application file for complete search history.

(56) References Cited

U.S. PATENT DOCUMENTS

| | | | | |
|---|---|---|---|---|
| 416,425 | A | 12/1889 | Schmitt | |
| 1,849,565 | A | 3/1932 | Brady | |
| 2,012,800 | A | 8/1935 | Allen | |
| 2,034,030 | A * | 3/1936 | Gaugler | 62/329 |
| 2,123,359 | A * | 7/1938 | Hallmark | 126/391.1 |
| 3,391,816 | A * | 7/1968 | Swett | 220/534 |
| 3,459,327 | A | 8/1969 | Harris | |
| 3,581,906 | A | 6/1971 | Joyce | |
| 3,698,404 | A | 10/1972 | Greco | |
| D229,366 | S | 11/1973 | Yonce | |
| 3,836,043 | A | 9/1974 | Levin | |
| 4,147,277 | A * | 4/1979 | Bateman et al. | 220/574.2 |
| 4,210,252 | A | 7/1980 | Cooke et al. | |
| 4,213,532 | A | 7/1980 | Eggert et al. | |
| 4,226,348 | A * | 10/1980 | Dottor et al. | 224/42.34 |
| D264,396 | S | 5/1982 | Harvey et al. | |
| 4,346,813 | A | 8/1982 | Cho et al. | |

(Continued)

FOREIGN PATENT DOCUMENTS

| | | |
|---|---|---|
| DE | DT1814157 | 12/1968 |

(Continued)

*Primary Examiner*—Stephen J. Castellano
(74) *Attorney, Agent, or Firm*—Harness, Dickey & Pierce, P.L.C.

(57) ABSTRACT

A storage container having a unique hinge arrangement is provided. The container includes a cover and base portion having hinge portions extending therefrom. The hinge portions are molded from a die configuration that creates adjacent cavities formed vertically and laterally. The hinge portions are arranged such that the cover and base interfit to reveal a continuous passage. A pin is inserted through the continuous passage completing a workable hinge. The storage container includes internal lateral wall sections on the cover and base having tabs extending therefrom. The tabs are configured to accept removable spacers. The spacers include side walls that are contoured such that an object may be easily removed without becoming caught in an angled corner. Transparent lids are releasably latched to the inside of the cover and base. The latches for the lids are located in a position that requires each lid to be locked prior to closing the case.

4 Claims, 12 Drawing Sheets

U.S. PATENT DOCUMENTS

| | | | | | |
|---|---|---|---|---|---|
| 4,615,464 | A | | 10/1986 | Byrns | |
| 4,705,168 | A | * | 11/1987 | Ward | 206/373 |
| 4,838,445 | A | | 6/1989 | Lanius | |
| 4,884,689 | A | | 12/1989 | Su-Chin | |
| 4,930,753 | A | | 6/1990 | Alvyn | |
| 4,934,549 | A | | 6/1990 | Allen | |
| 4,955,495 | A | * | 9/1990 | Ruebesam | 220/545 |
| 5,050,733 | A | | 9/1991 | Brennan | |
| 5,102,001 | A | | 4/1992 | Teague et al. | |
| D330,621 | S | | 10/1992 | Apps | |
| D333,727 | S | | 3/1993 | Schurman | |
| 5,289,941 | A | * | 3/1994 | Blankenburg et al. | 220/552 |
| D345,650 | S | | 4/1994 | Boyd | |
| D347,114 | S | | 5/1994 | Tengvall | |
| 5,351,818 | A | | 10/1994 | Daneshvar | |
| 5,553,710 | A | | 9/1996 | Takama | |
| 5,593,058 | A | | 1/1997 | Spencer et al. | |
| 5,699,925 | A | | 12/1997 | Petruzzi | |
| D390,358 | S | | 2/1998 | Calmeise | |
| D400,011 | S | | 10/1998 | Palmer et al. | |
| 5,915,553 | A | | 6/1999 | Brown et al. | |
| D417,077 | S | | 11/1999 | Sheu | |
| D418,977 | S | | 1/2000 | Streich | |
| 6,065,595 | A | | 5/2000 | Ratcliff | |

FOREIGN PATENT DOCUMENTS

| | | |
|---|---|---|
| DE | G8814319.8 | 11/1988 |
| DE | G8906411.9 | 5/1989 |
| DE | G8907073.9 | 6/1989 |
| WO | WO94/11258 | 5/1994 |

* cited by examiner

STORAGE CONTAINER

CROSS-REFERENCE TO RELATED APPLICATIONS

This application is a divisional of U.S. patent application Ser. No. 09/840,278, filed on Apr. 23, 2001, now U.S. Pat. No. 7,048,133, the disclosure of which is incorporated herein by reference.

FIELD

The present invention relates generally to storage containers, and more particularly to a storage container having a unique divider system and hinge configuration.

BACKGROUND

Storage containers exist in many varieties and may be used to store, organize and transport various items such as fasteners, tool bits and other accessories.

The storage container of the present invention is designed such that it may simplify the manufacturing of a storage container. Plastic storage containers can be typically manufactured fairly inexpensively, but often at the expense of being less rigid and providing less flexibility in adapting the storage container to store items of various sizes and shapes. When used to store tool bits, fasteners or accessories on a job site, a storage case must be built to be strong and durable so that if it is dropped, it does not break open and spill its contents. Storage containers often include a base portion and a cover portion hingedly connected to the base portion.

Conventionally, molding a plastic cover with an integrated hinge portion would involve a first step of positioning a metal rod in the section of the die to consist of the hinge portion and a second step of removing the metal rod after the cover is molded to reveal the resultant continuous passage for the pin of the hinge. The base portion of the case would be molded in a similar fashion with the resultant hinge portion able to interfit with the hinge portion of the cover such that a pin may be inserted therethrough creating a hinged container. It would be desirable to mold the cover and base including the hinge side of a storage container each in a single step.

SUMMARY

The storage container in accordance with this invention provides an improved storage container and method to mold the same. The molding process incorporates strategically placed bores and apertures in a die. The bores and apertures are formed at right angles such that they cooperate to form a continuous passage able to accept a pin to form a hinge. A base, cover and two internal transparent lids are each constructed with the unique hinge configuration.

The container includes internal lateral wall sections on the cover and base having tabs extending therefrom. Removable spacers slidably interfit with the tabs to allow the user to customize the interior of the container.

The transparent lids of the internal compartment have slidable latches for engagement with inner slots of the cover and base. The latches are aligned such that both lids must be secured in the locked position prior to properly closing the storage container.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
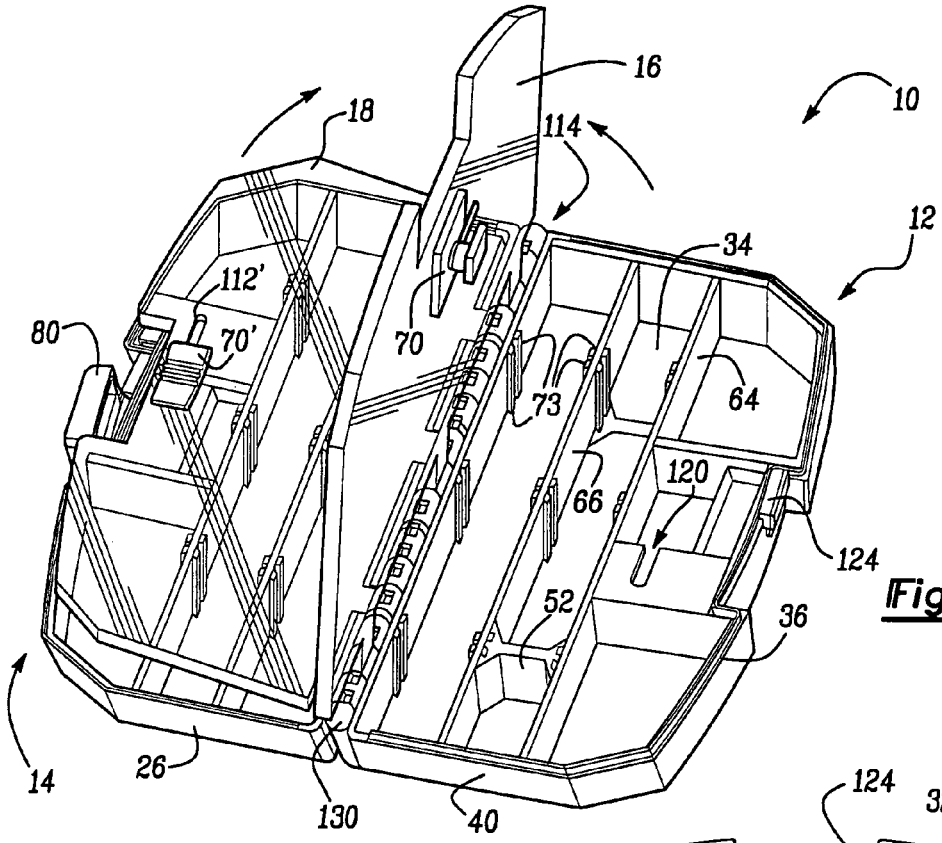
FIG. 1 is a perspective view of an assembled storage container shown in an open position.
Figure 9:
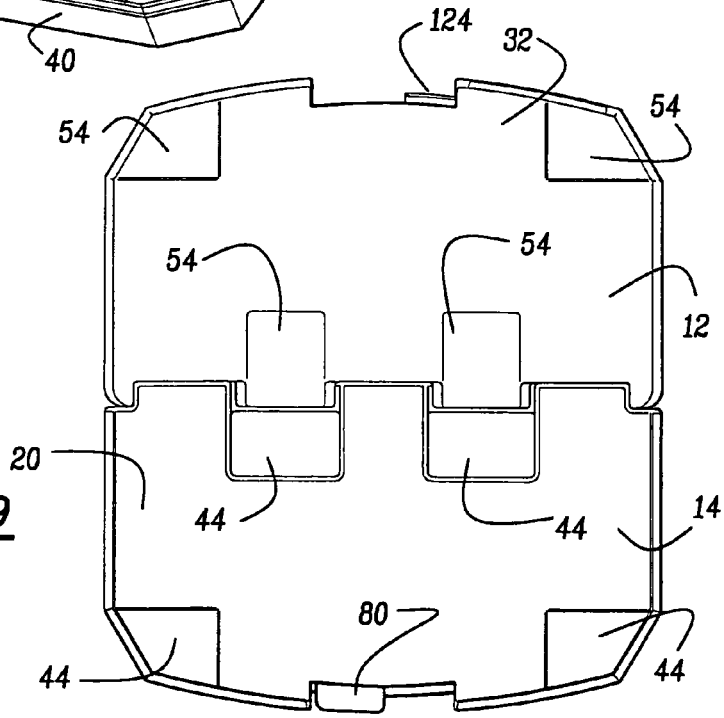
FIG. 9 is a plan view of an assembled storage container shown in an open position to illustrate the outer surface of the cover and base.

The following description is merely exemplary in nature and is not intended to limit the present disclosure, application, or uses. It should be understood that throughout the drawings, corresponding reference numerals indicate like or corresponding parts and features.

With reference to FIG. 1, the storage container 10 of the present invention is shown. The storage container 10 includes a base 12 and a cover 14 hingedly attached to the base 12. A pair of transparent cover plates 16, 18 are provided for selectively enclosing the storage area defined by the base 12 and cover 14, respectively.

As shown in FIGS. 2A–2E, the cover 14 includes a cover surface 20, an inner surface 22, a top wall 24, side walls 26, 28 and a bottom wall 30. Similarly, referencing now FIGS. 3A–3E, the base 12 includes a bottom surface 32, an inner surface 34, a top wall 36, side walls 38, 40 and bottom wall 42. The storage container 10 includes removable spacers 52 (FIG. 1 and FIG. 5) that may be selectably positioned within the storage container to customize the interior space. Slidable latches 70, 70' releasably secure cover plates 16 and 18 to the base 12 and cover 14, respectively. Latch 80 releasably secures cover 14 to the base 12.

With continued reference to FIGS. 2A–2E, the cover 14 will now be described in greater detail. Cover surface 20 is contoured to include upwardly extending portions 44. The inner surface 22 includes parallel dividers 46, 56 extending between side walls 26, 28. Parallel dividers 46, 56 and bottom wall 30 include tabs 48 extending therefrom. Tabs 48 are configured to engage fingers 50 of removable spacers 52 (best shown in FIG. 5). Opposing tabs 48*a*, 48*b* (FIG. 2B), are laterally offset a predetermined distance such that a readily available piece of material may be substituted for a spacer 52, in the event a spacer is misplaced. The predetermined distance is configured to be a distance common to readily available scrap pieces of material such as, but not limited to, ⅛ inch plywood. Bottom surface 30 includes integrated hinge member 76. A slot 58 is configured to accept a finger 98 on latch 70' (best shown in FIGS. 1 and 6) of cover plate 18.

Turning now to FIGS. 3A–3E, the base 12 will now be described in greater detail. The inner surface 34 of the base 12 is configured much the same as the cover 14. Base surface 32 includes recessed portions 54. The recessed portions 54 are coordinated to interfit with the upwardly extending portions 44 of cover 14 such that a series of cases 10 may be securely stacked. The inner surface 34 includes parallel dividers 64, 66 extending between side walls 38, 40. Parallel dividers 64, 66 and bottom wall 42 include tabs 68 extending therefrom. Tabs 68 are configured to engage tabs 50 of removable spacers 52 (best shown in FIGS. 1 and 5). Opposing tabs 68*a*, 68*b* are laterally offset a predetermined distance such that a scrap piece of material may be substituted for a spacer 52 as described above. Base 12 includes integrated hinge member 86. A slot 120 is configured to accept finger 98 on latch 70 (best shown in FIGS. 1 and 6) of cover plate 16.

The storage container 10 of the present invention allows the apertures of the hinge portion to be formed without the need of a metal rod for forming the apertures. The configuration of the cover 14 and the base 12 illustrated in FIGS. 2A–3E include hinge portions 76 and 86, respectively. The hinge member 76 of cover 14 including tab portions 78 which are formed from a die configuration that creates cavity sections 82 (FIG. 2B) in a direction perpendicular to the plane of cover 14. Additionally, the die allows cavity sections 84 (viewed from FIG. 2E) to be formed in a direction parallel to the plane of cover 14 and in a location between cavity sections 82. The insert portions of the die are strategically located such that cavity sections 82 and 84 cooperate to form a continuous passage 88 (FIGS. 2B and 2D) which is created without the need for additional steps involving a metal rod die insert as is required with conventional hinge molding techniques.

Figure 3A:
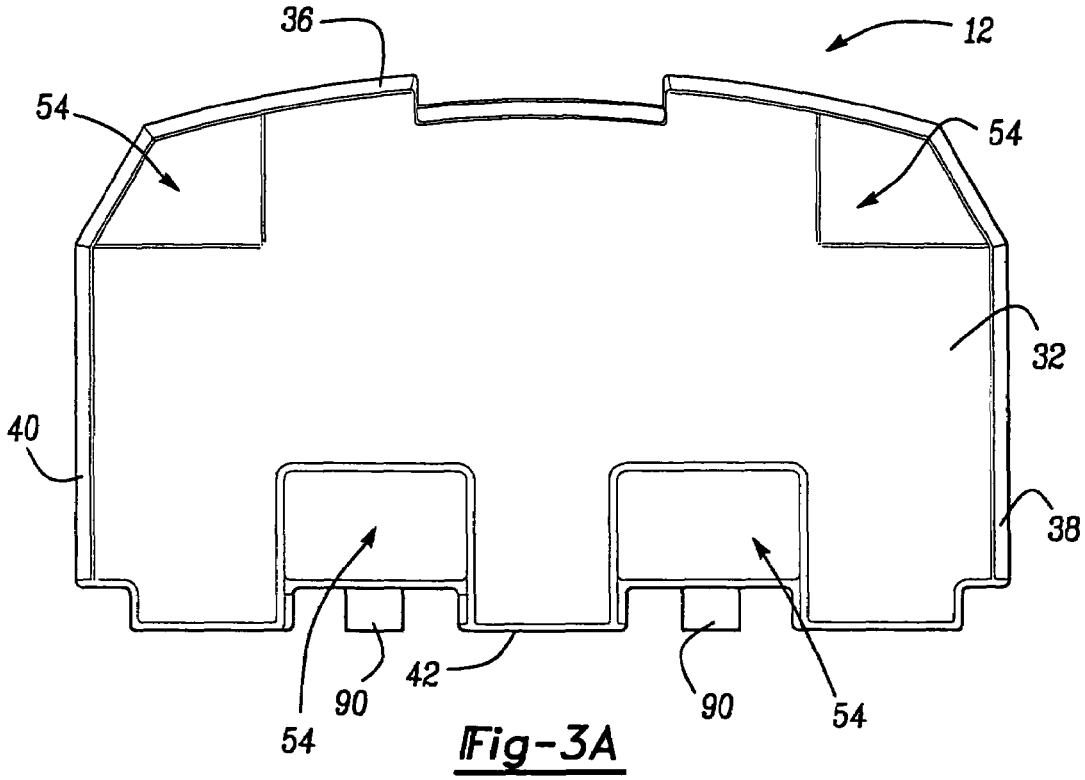
FIG. 3A is a plan view of the outer surface of the base of the storage container constructed in accordance to the teachings of the preferred embodiment.
Figure 3B:
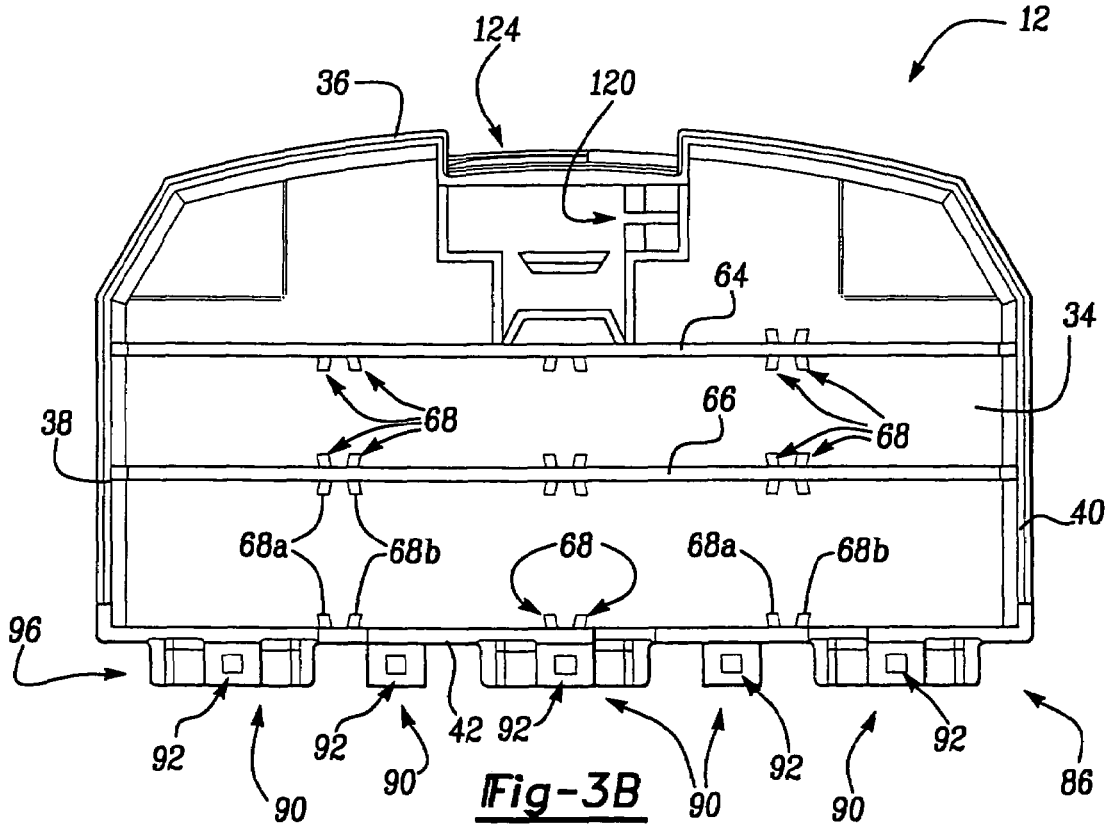
FIG. 3B is a plan view of the inner surface of the base.
Figure 3C:
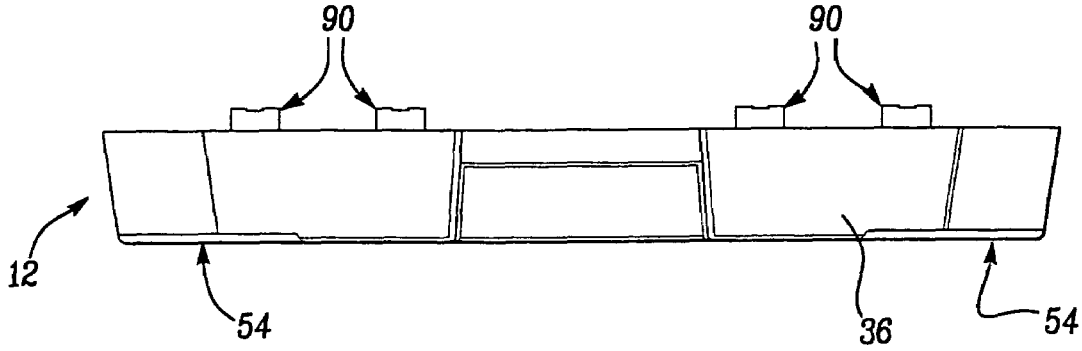
FIG. 3C is a top view of the base.
Figure 3D:
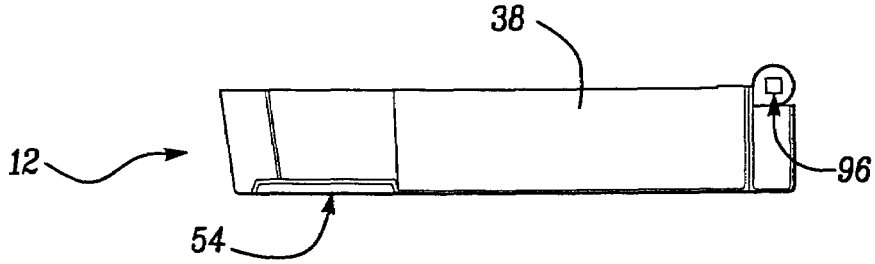
FIG. 3D is a side view of the base.
Figure 3E:
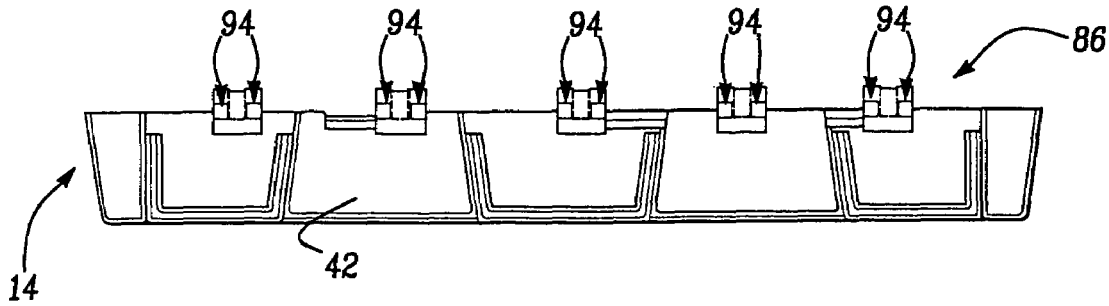
FIG. 3E is a bottom view of the base.

The base 12 is molded in a similar fashion to create a continuous passage for a hinge pin. Tab portions 90 of hinge member 86 include cavity sections 92 (FIG. 3B) perpendicular from the plane of base 12. Accordingly, cavities 94 (FIG. 3E) are also incorporated in a direction parallel to the plane of base 12. Cavities 92 and 94 cooperate to form a continuous passage 96 (FIG. 3B and FIG. 3D).

Figure 4A:
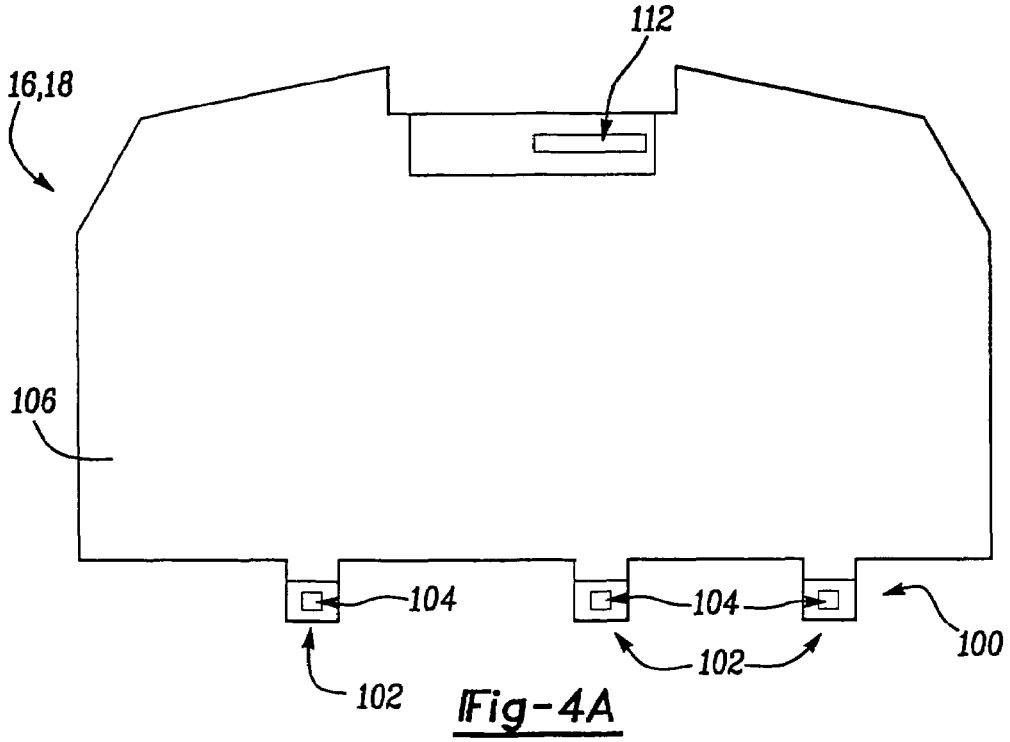
FIG. 4A is a plan view of the first side of a cover plate according to the principles of the present invention.
Figure 4B:
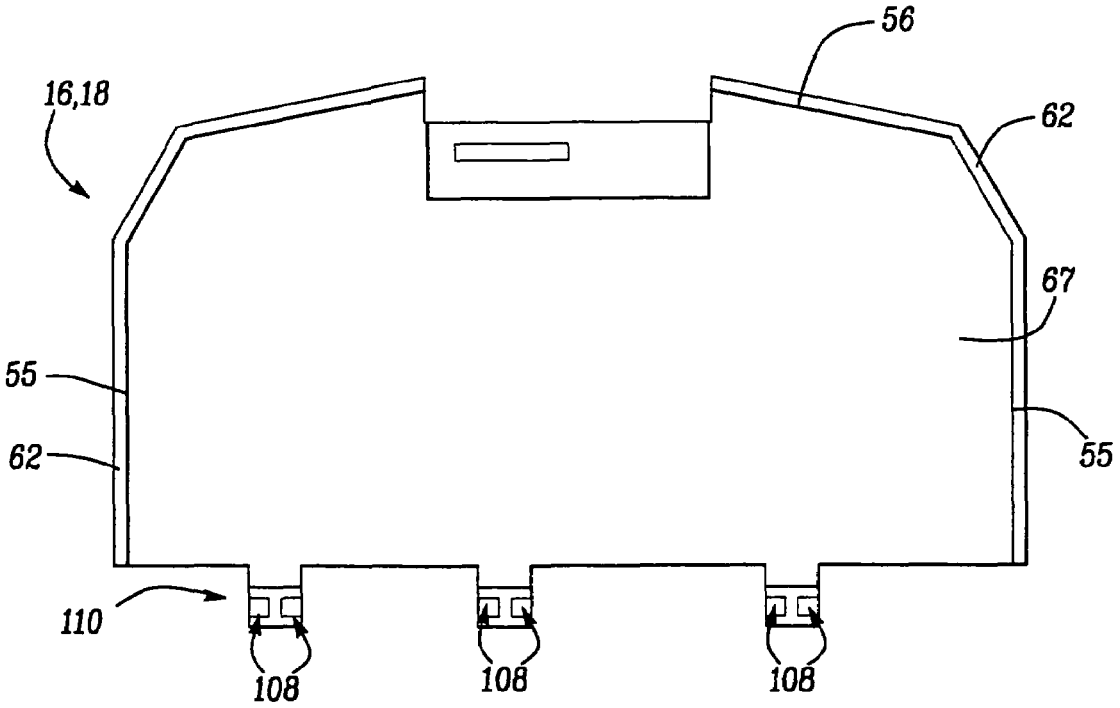
FIG. 4B is a plan view of the second side of the cover plate.
Figure 4C:
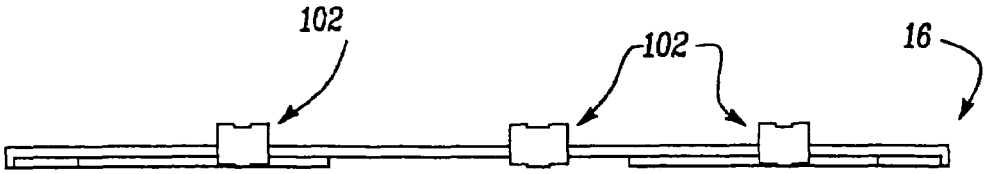
FIG. 4C is a rear view of the cover plate.
Figure 4D:
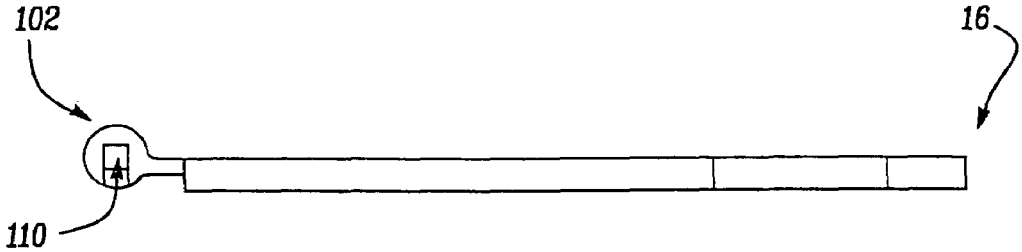
FIG. 4D is a side view of the cover plate.
Figure 6:
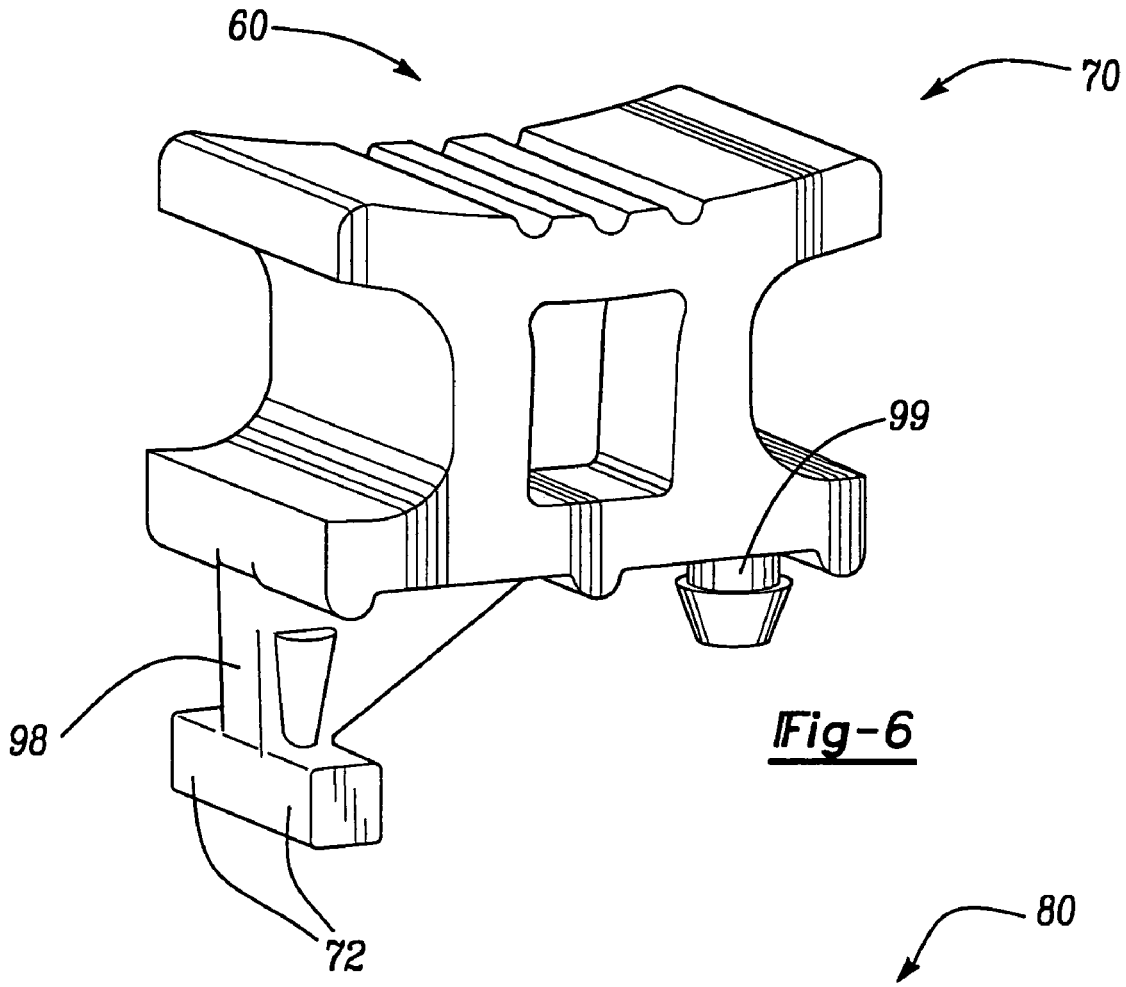
FIG. 6 is a perspective view of a cover plate latch according to the principles of the present invention.

Turning now to FIGS. 4A through 4D, the interior of case 10 includes two symmetric transparent cover plates 16, 18. The cover plates 16, 18 are molded with the same hinge strategy as mentioned for the cover 14 and base 12. The tab portions 102 of hinge sections 100 include cavities 104 formed perpendicular to face 106 of cover plate 16, 18 on a first side of the cover plates 16, 18. Cavities 108 are also formed from the geometry of the die and are perpendicular to face 106 on a second side of the cover plates 16, 18. Cavities 104 and 108 are parallel to each other and offset which cooperate to form a continuous passage 110 (FIG. 4D). The tab portions 102 of the cover plates are laterally offset such that a first cover plate 16 may be turned 180 degrees from a second cover plate 18 allowing the tab portions 102 to interfit. This feature allows both cover plates 16, 18 to be molded from the same die. Cover plates 16, 18 include a slot 112 integrated thereon to accept slidable latches 70, 70' (FIGS. 1 and 6).

Figure 8A:
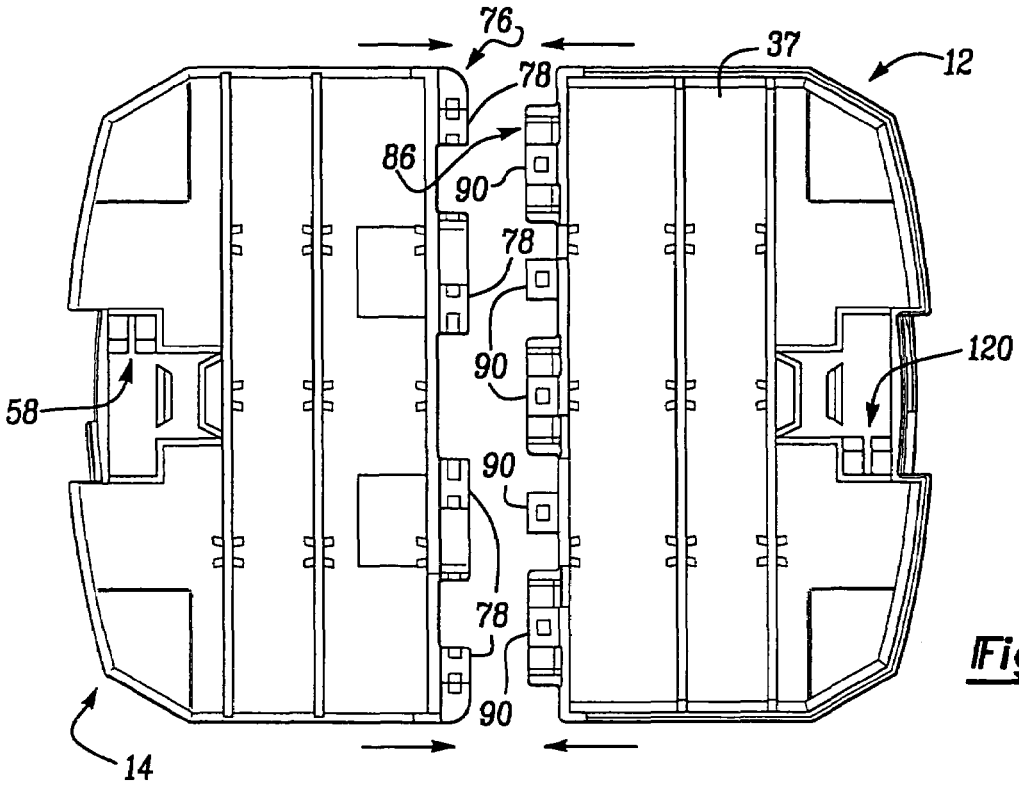
FIG. 8A is a plan view of the inner surfaces of the cover and base to illustrate the alignment of the tab portions.
Figure 8B:
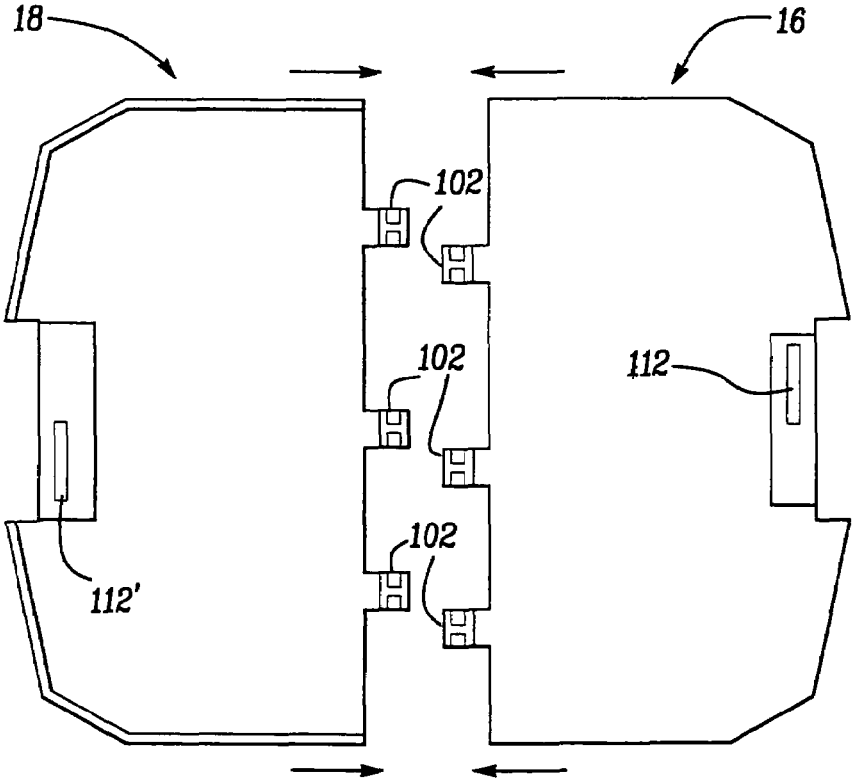
FIG. 8B is a plan view of the first and second cover plates, the second cover plate identical to the first but rotated and flipped 180 degrees from the first cover plate.

Referring now to FIGS. 8A and 8B, tab portions 90 of hinge 86 of the base 12 are offset from hinge portions 78 of cover 14 so as to interfit when mated. Furthermore, the tab portions 102 of the cover plates 16, 18 are positioned between hinge members 86, 76 of the base 12 and cover 14, respectively (placing FIG. 8B onto FIG. 8A to create FIG. 1). The respective hinge portions 90 of base 12, 78 of cover 14 and 102 of cover plates 16, 18 interfit to define one continuous passage 114 aligned to accept a hinge pin 130 (FIG. 1).

Figure 5:
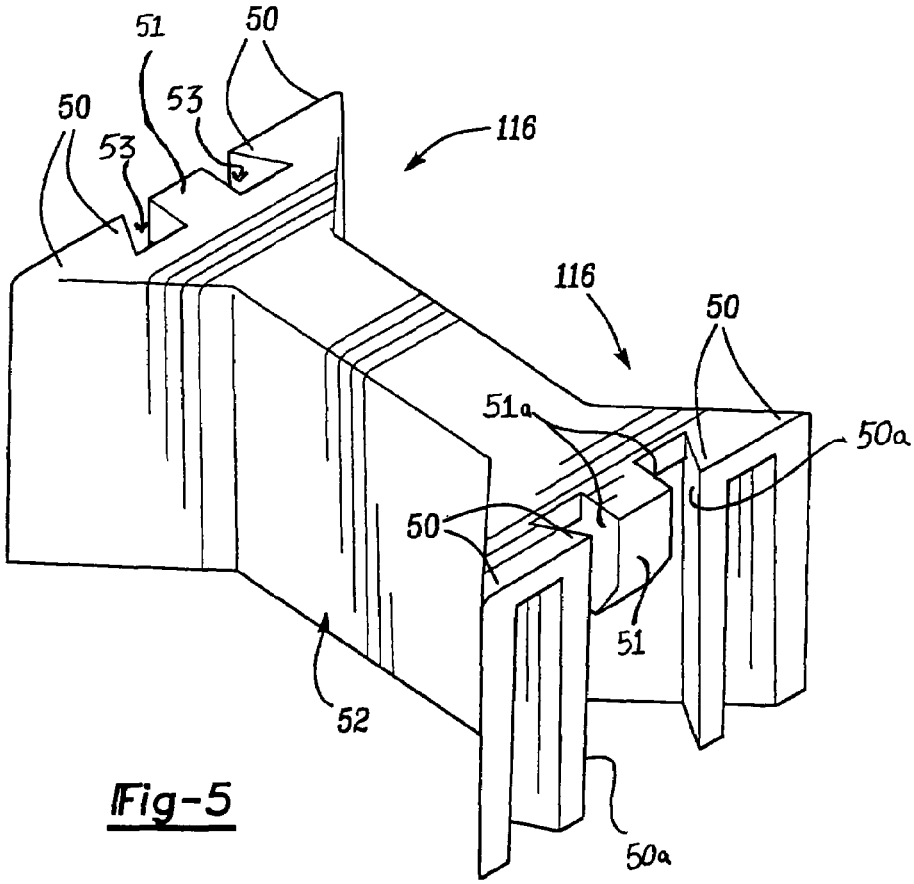
FIG. 5 is a perspective view of a spacer according to the principles of the present invention.
Figure 7:
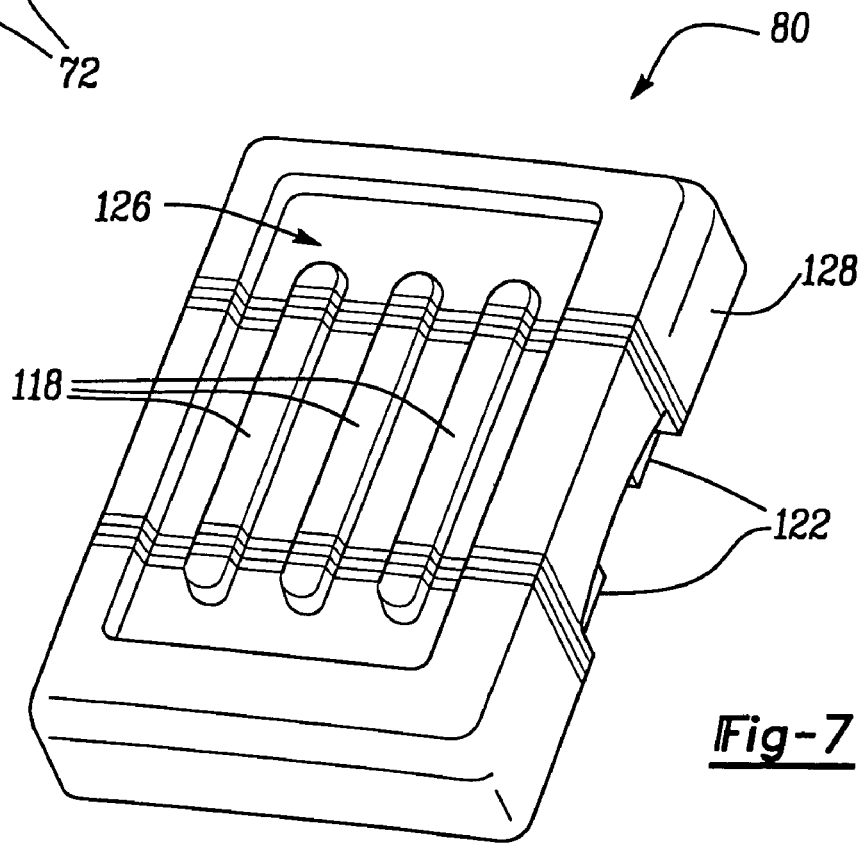
FIG. 7 is a perspective view of the storage case latch member according to the principles of the present invention.

Turning now to FIG. 5, the spacer 52 will now be described. A series of spacers 52 will be included for the user to customize the size of the inner compartments. Spacer 52 includes flared arms 116 having fingers 50 extending therefrom. Central block portions 51 extend generally parallel to a longitudinal axis of the spacer 52. The fingers 50 are adapted to slidably engage tabs 48 of cover 14 or tabs 68 of base 12. More specifically the fingers 50 define outer walls 50*a* that cooperate with inner walls 51*a* defined on the central block portions 51 to form slots 53. In an installed position, the tabs 48 and 68 rest within the slots 53. The spacers 52 are made from a flexible material such as soft rubber or other elastomeric material. The spacers 52 are configured to maintain a constant slope in the uninstalled position (FIG. 5) and the installed position (FIG. 7). The flared arms 116 of spacers 52 are contoured such that an object may be easily removed from the box without becoming caught in a 90 degree corner of an inner compartment. The internal configuration also provides shock resistance in the event of a drop or sudden impact.

Referencing now FIGS. 4A, 4B and 6 with continued reference to FIG. 1, the cover plates 16 will now be described. Cover plate 16 includes a latch 70 slidably engaged with slot 112. The latch 70 (best shown in FIG. 6), includes body 74, having an arm 98 and outwardly extending fingers 72 and tang 99. Wing section 60 has a contoured surface to enhance grip while sliding latch 70. Latch 70 is slidably engaged to slot 112 of cover plate 16. When a cover plate 16 is in its closed position, latch 70 may be laterally moved such that fingers 72 of arm 98 engage the rear surface of slot 120 securing the cover plate 16 to base 12 in a locked position.

The second cover plate 18 (identical to the first cover plate but flipped 180 degrees) also includes a slot 112' and latch 70'. The latch 70' slidably engages slot 58 of cover 14 when in a locked position. The relationship of latches 70, 70' to cover plates 16 and 18 are such that the latches 70, 70' of the cover plates 16, 18 must be in a locked position in order for the carrying case 5 to properly close. Explained further, if the latches 70, 70' are not in a locked position, the wing 60 of latches 70, 70' will abut against one another preventing the case 10 from properly closing.

Figure 2A:
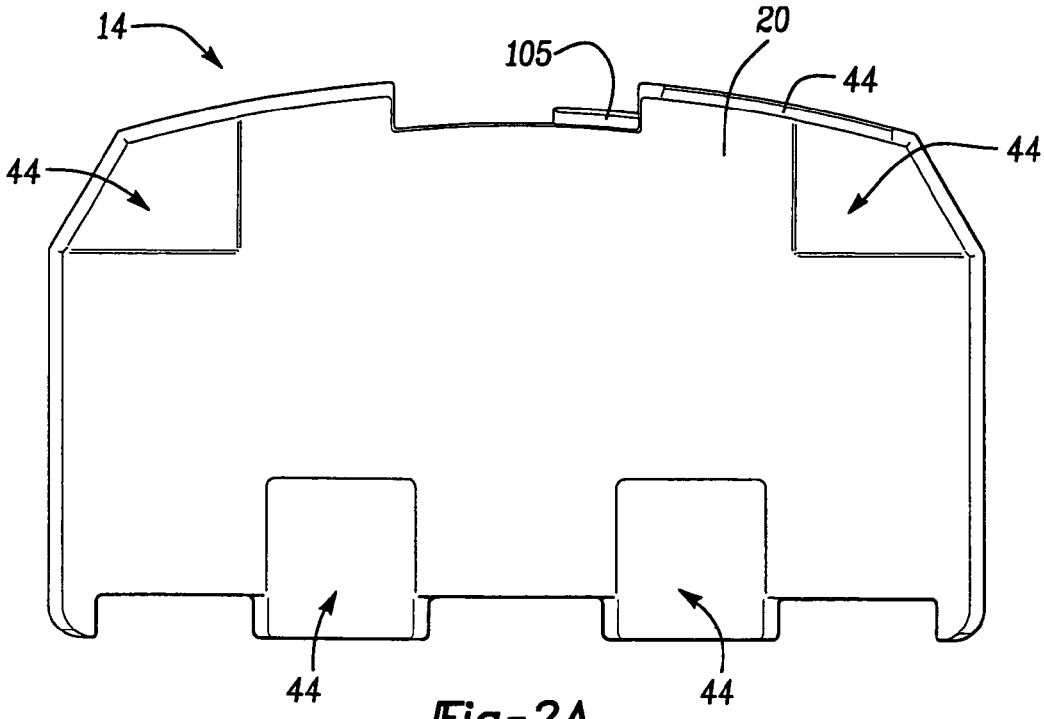
FIG. 2A is a plan view of the outer surface of the cover constructed in accordance to the teachings of the preferred embodiment.
Figure 2B:
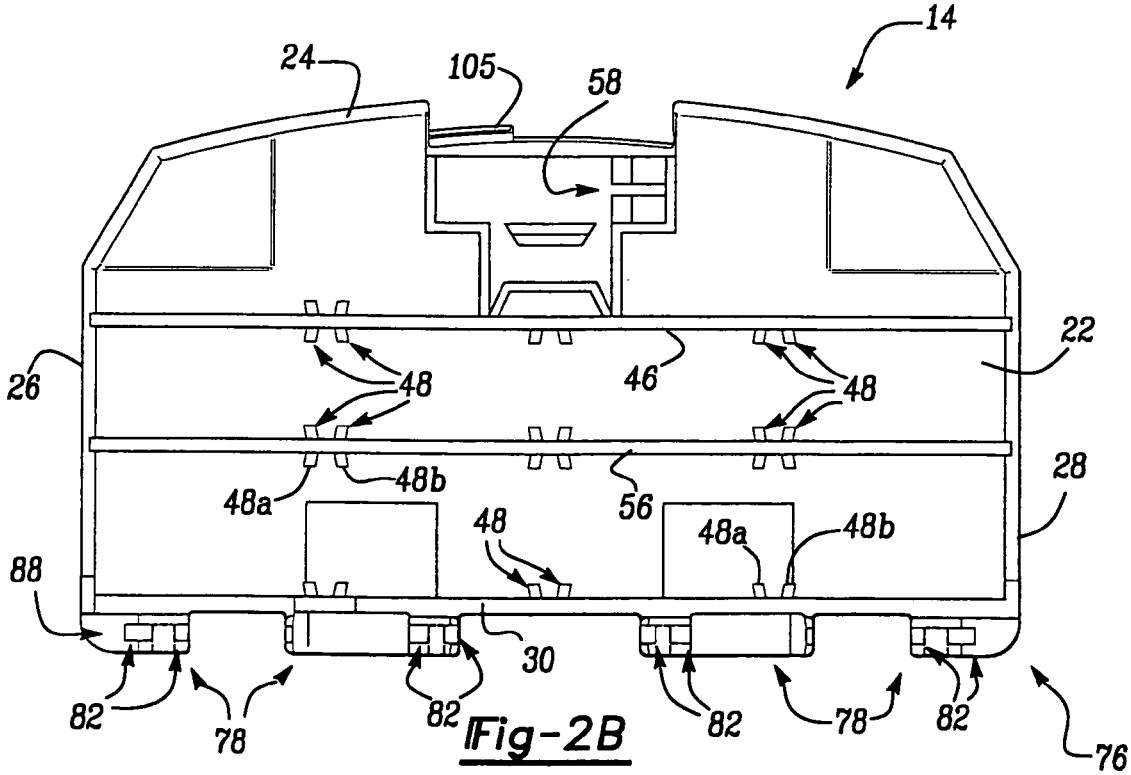
FIG. 2B is a plan view of the inner surface of the cover.
Figure 2C:
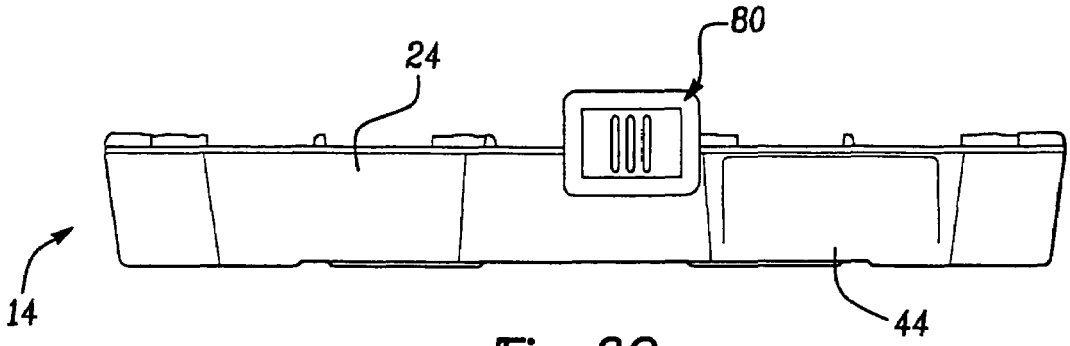
FIG. 2C is a top view of the cover.
Figure 2D:
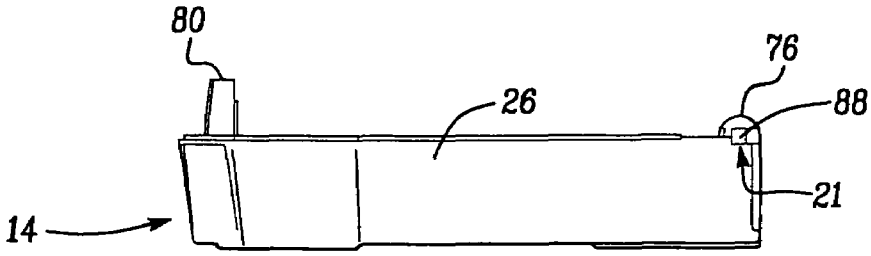
FIG. 2D is a side view of the cover.
Figure 2E:
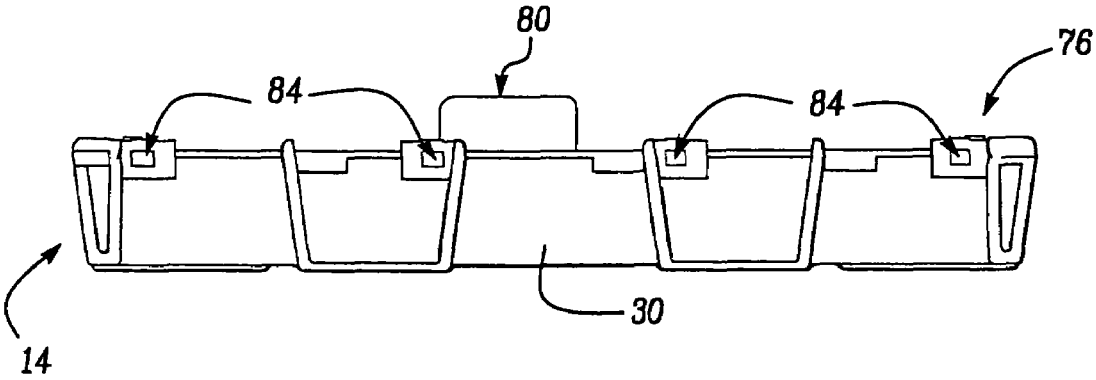
FIG. 2E is a bottom view of the cover.

Turning now to FIG. 7 with continued reference to FIGS. 2A and 2B, the cover 14 includes a slidable latch 80. The slidable latch 80 includes outer circumferential wall 128 including fingers 122 for engagement with track 124 of base 12 and track 105 on cover 14. Ribs 118 laterally extend from face 126 of latch 80 to improve grip.

Figure 10A:
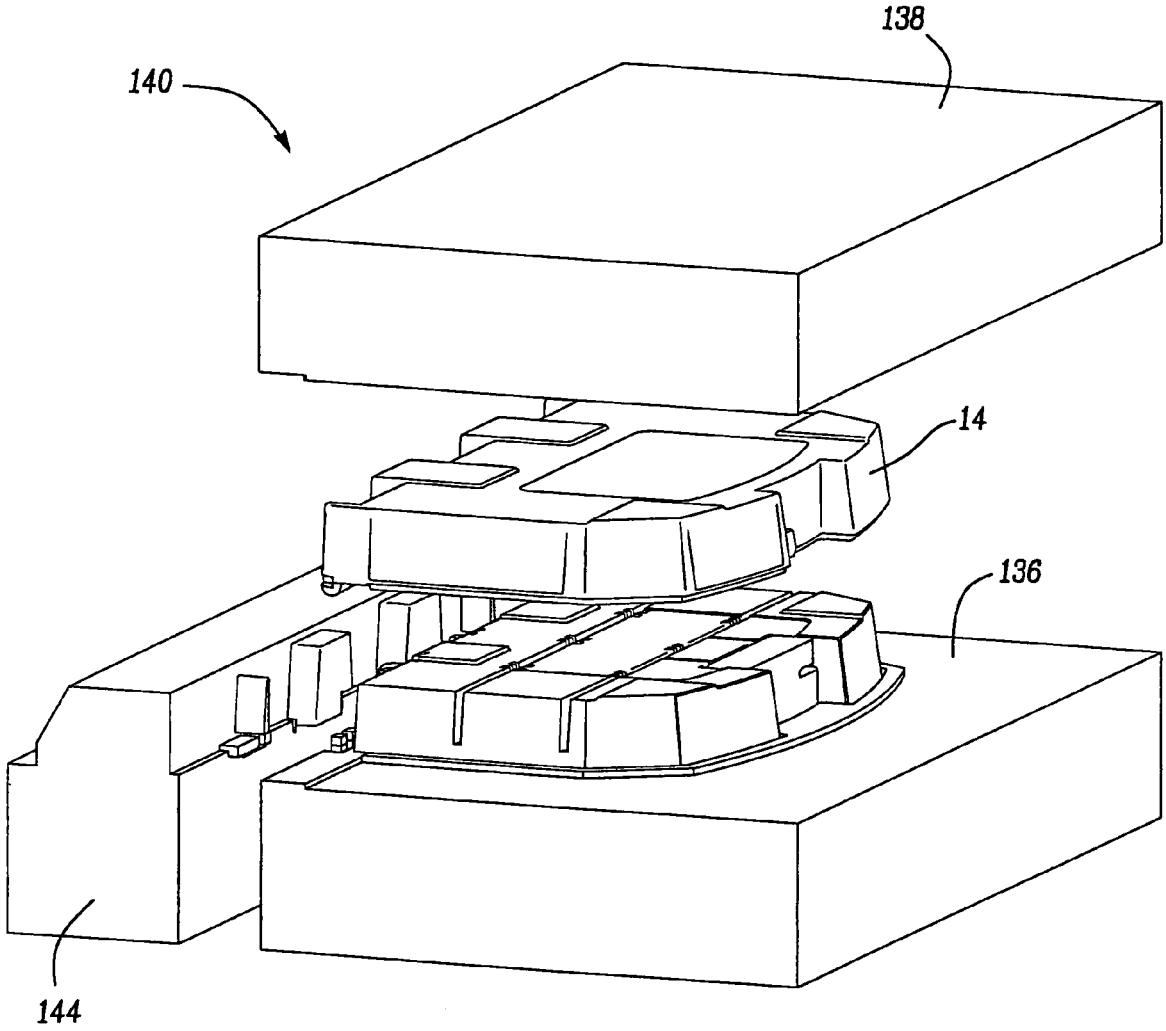
FIG. 10A is an exploded perspective view of a mold used to construct a cover portion of the storage container according to the preferred method of the present invention.
Figure 10B:
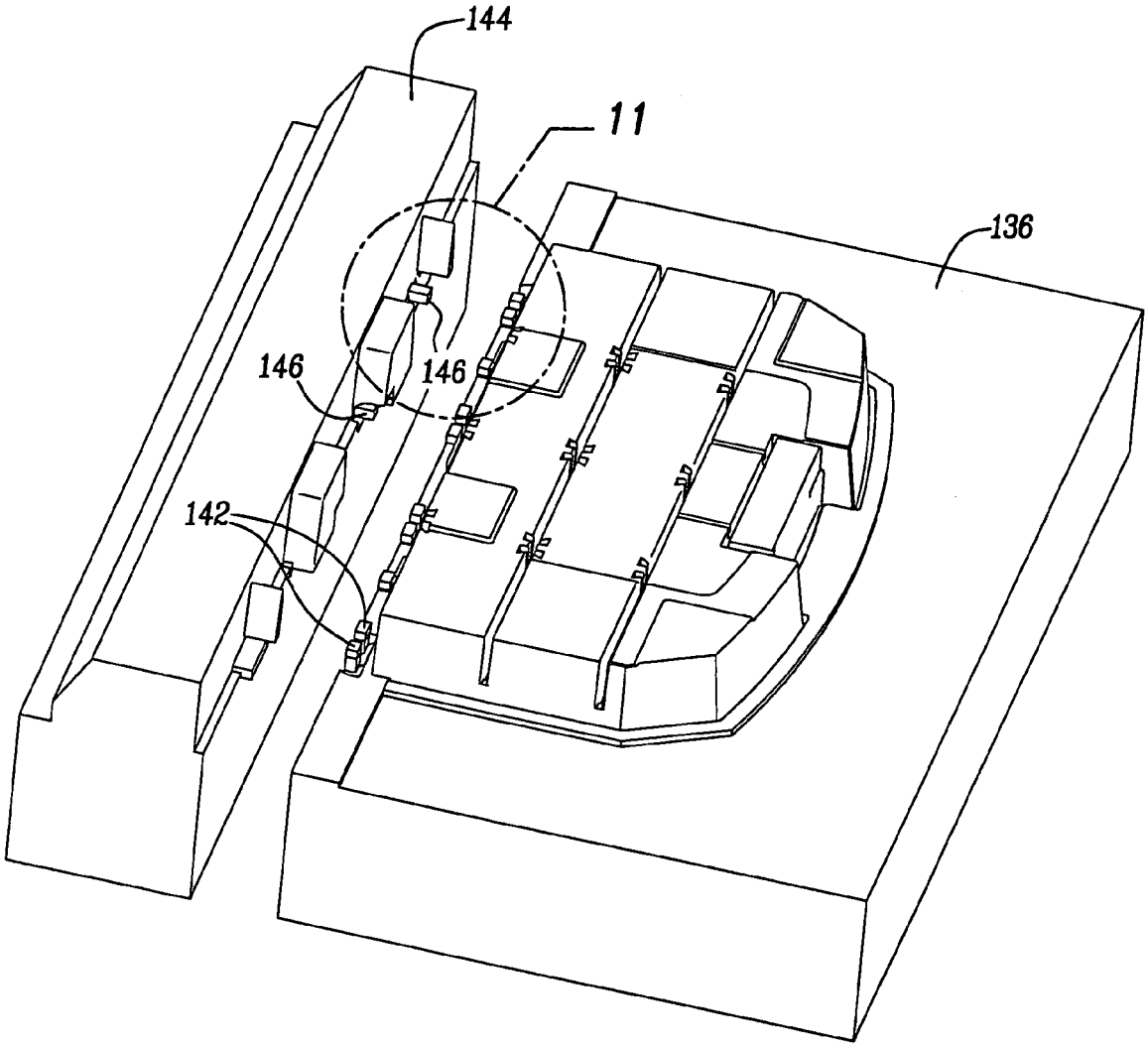
FIG. 10B is an exploded perspective view of the bottom and side mold members used to construct the cover portion according to the preferred method of the present invention.
Figure 11:
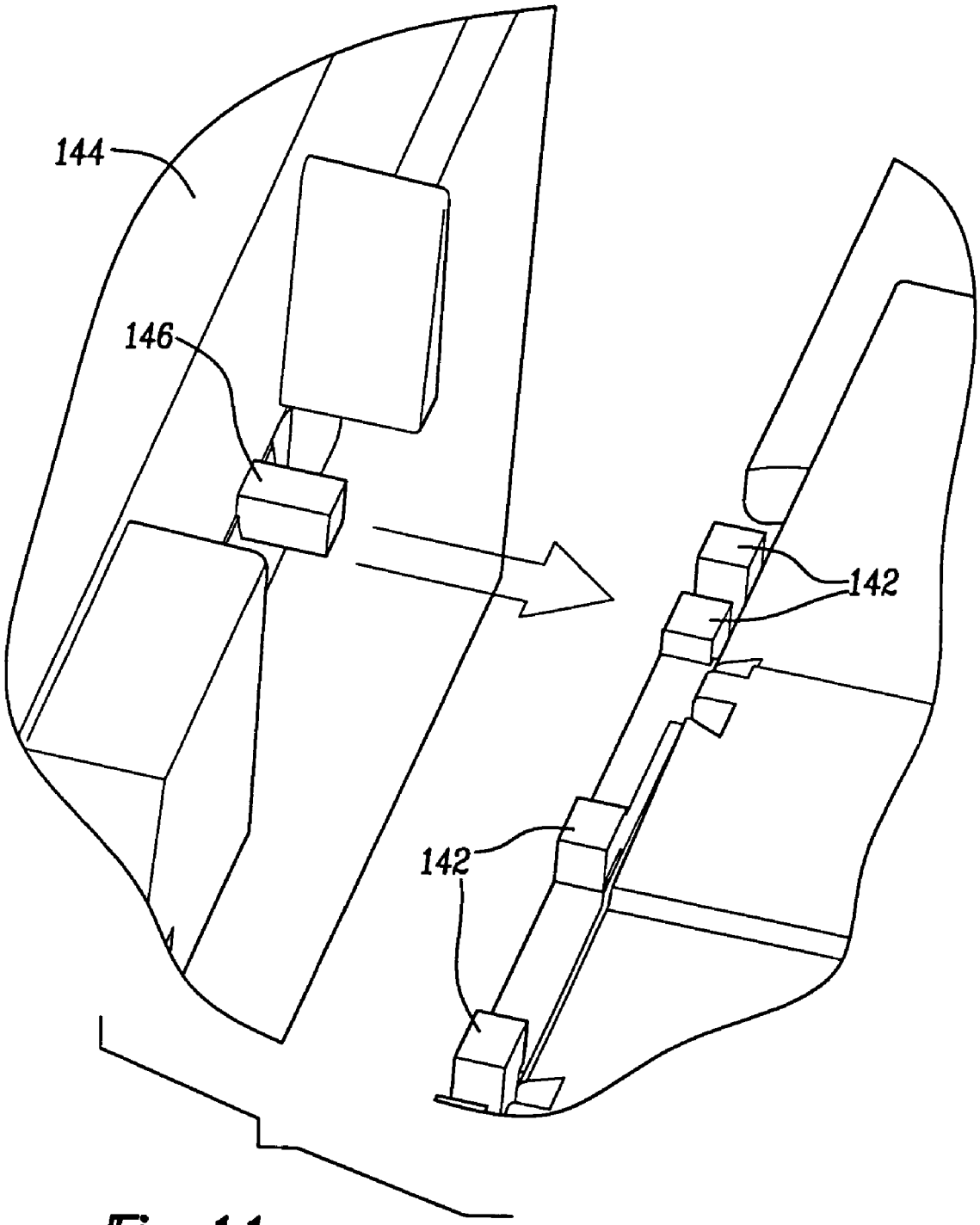
FIG. 11 is an enlarged perspective view of the area 11 of FIG. 10 illustrating the alignment of the hinge forming pegs.

Referencing FIGS. 10 and 11, the mold used to construct the cover 14 of the storage container 10 will now be described. The tool 140 includes a first and second die member 136 and 144. Die 136 includes vertical pegs 142 extending therefrom and tab sections 150. The base 12 is molded from a similar tool having a corresponding peg and tab arrangement which are offset from those of the cover tool 140 such that the molded parts cooperate to form a hinge. As such, a similar die arrangement is used to mold the cover plates 16, 18.

The method of constructing the cover 14 and base 12 of storage container 10, will now be described. In a first general step the preferred method of the present invention provides a first tool 140 having a first die member 136 including a series of pegs 142 extending in a first direction and a second die member 144 including a series of pegs 146 extending in a perpendicular direction.

In a second general step, the preferred method of the present invention introduces the molten plastic material to the first tool 140.

In a third general step, the first and second die members 136 and 144 are removed to reveal a cover 14 having a first continuous passage 88.

The base 12 is formed similar to the cover 14.

The first continuous passage 88 of cover 14 is then aligned with the second continuous passage 96 of base 12 and the passage 110 through cover plates 16, 18. A pin 130 is inserted through the passages 88, 96 and 110.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A spacer for selectively locating within a storage container between an uninstalled position and an installed position, said spacer comprising:

a unitary body having a first end section defining a first terminal end surface, a middle section and a second end section defining a second terminal end surface, said body maintaining a constant shape in the uninstalled and installed positions, said first and second end sections having cross sections that define a uniform outward taper from said middle section to said respective first and second terminal end surfaces, said middle section defining a constant cross section between said first and second end sections, the first and second terminal end surfaces being planar and perpendicular to the middle section, said first and second end sections further including at least one slot formed thereon adapted for slidably receiving at least one tab member extending from the container in an installed position, said at least one slot including first and second slots each having an inner wall extending from respective first and second terminal end surfaces of said first and second end sections, said inner wall of said first and second slots being substantially parallel to said middle section, said first and second slots further including an outer wall extending outwardly toward said first and second terminal end surfaces of said respective first and second end section.

2. The spacer of claim 1 wherein said first and second end sections include walls extending at an obtuse angle from said middle portion.

3. The spacer of claim 1 wherein the spacer is made from an elastomeric material.

4. The spacer of claim 1 wherein said first and second end sections are symmetric.

* * * * *